US008282231B2

(12) United States Patent
Chang

(10) Patent No.: US 8,282,231 B2
(45) Date of Patent: Oct. 9, 2012

(54) CHANGEABLE FACIAL EXPRESSION CONFIGURATION AND CHANGEABLE FACIAL EXPRESSION GARMENT COMPOSED THEREOF

(75) Inventor: Chang Ho Chang, Guangdong (CN)

(73) Assignee: Sun Solutions Ltd. (CN)

( * ) Notice: Subject to any disclaimer, the term of this patent is extended or adjusted under 35 U.S.C. 154(b) by 492 days.

(21) Appl. No.: 12/472,620

(22) Filed: May 27, 2009

(65) Prior Publication Data

US 2010/0301778 A1 Dec. 2, 2010

(51) Int. Cl.
*F21V 21/08* (2006.01)
*A63H 3/12* (2006.01)

(52) U.S. Cl. ..... 362/103; 446/321; 446/392; 362/808

(58) Field of Classification Search ..... 362/103, 362/808; 446/321, 392
See application file for complete search history.

(56) References Cited

U.S. PATENT DOCUMENTS

| | | | | |
|---|---|---|---|---|
| 4,709,307 | A * | 11/1987 | Branom | 362/103 |
| 4,710,145 | A * | 12/1987 | Hall Vandis | 446/100 |
| 5,919,227 | A * | 7/1999 | Bello | 623/6.64 |
| 6,095,657 | A * | 8/2000 | Kent | 362/108 |
| 6,651,365 | B1 * | 11/2003 | Wainwright | 40/452 |
| 7,485,025 | B2 * | 2/2009 | Schnuckle | 446/392 |

FOREIGN PATENT DOCUMENTS

GB 2200567 A * 8/1988

* cited by examiner

*Primary Examiner* — Robert May
(74) *Attorney, Agent, or Firm* — Garcia-Zamor IP Law; Ruy M. Garcia-Zamor

(57) ABSTRACT

This invention relates to a changeable facial expression configuration, including a facial expression layer and an eyeball changeable device. The eyeball changeable device includes a light transmission eyeball body, and a light transmission eyeball pattern layer located in the light transmission eyeball body that is able to embody at least two different expressions with different colors, and a luminous body located with a certain distance in the rear area of the pattern layer that is able to respectively emit the light colors in accordance with the light colors of the eyeball pattern layer. The luminous body connects with the control circuit, and emits light alternately by the control of control circuit. The changeable facial expression configuration in the invention exhibits pattern layers alternately by the light transmission eyeball pattern layers with two or more different colors that located in the light transmission eyeball body and the LED luminous body located with a certain distance in the rear area of the light transmission pattern layers, and by omitting light with different colors from LED luminous body, to achieve a perfect effect of eye movement or wink. The utility mode has merits with simple structure and less raw material consumption, and is able to apply to in all the ornaments that need to decorate with changeable facial expression such as clothes, handbags and fruit plates.

10 Claims, 4 Drawing Sheets

CHANGEABLE FACIAL EXPRESSION CONFIGURATION AND CHANGEABLE FACIAL EXPRESSION GARMENT COMPOSED THEREOF

TECHNICAL FIELD

The invention relates to a facial expression configuration; especially refer to a changeable facial expression configuration, and the changeable ornaments composed by the changeable facial expression configuration.

BACKGROUND ART

The facial expression configuration in current technology usually is directly printed in the surface of the articles that needed to be decorated, whose representation is quite single and stiff, could not fulfill people's needs. In order to overcome such shortage, some people try to alter the facial expression of the ornaments by other representations, such as using electronic display screen to represent the facial expression. However, it would cost more to use electronic display screen; Furthermore, it could not be widely applied to our daily decoration needs, such articles that require to be cleaned by water as garment, handbag, and fruit plate and so on.

Contents of the Invention

Aiming at the shortcomings above in existing technology, this invention is to provide a simple structure, less raw material consumption The other aim of this invention is to provide a changeable facial expression garment composed by the changeable facial expression configuration.

To achieve the objective above, this invention adopts the following technical solution:

A changeable facial expression configuration, including a facial expression layer and an eyeball changeable device; wherein the eyeball changeable device includes a light transmission eyeball body, and a light transmission eyeball pattern layer located in the light transmission eyeball body that is able to embody at least two different expressions with different colors, and a luminous body located with a certain distance in the rear area of the pattern layer that is able to respectively emit the light colors in accordance with the light colors of the eyeball pattern layer; The luminous body connects with the control circuit, and emits light alternately by the control of control circuit.

The foresaid light transmission eyeball body is a solid eyeball structure; The inner surface of the front of the eyeball body has a light transmission eyeball pattern layer with two types of color that is able to embody at least two different expressions, while at least two LED luminous body fixed in the circuit board of the rear area of the eyeball body that is able to emit the light color in accordance with the light transmission eyeball pattern layer, and connected with the circuit control by wires.

The foresaid circuit control includes a battery compartment, a circuit board and control switch, wherein the circuit board located within the battery compartment; The right and left set of the battery compartment has right and left lugs that fastened by the belt-style magic tape or joined by the belt-style strap, wherein the upside has a fixed loop that could be stitched on the flexible base material, while the underside has a bottom lug fixed on the base material; Or a fixture is located in the surface between the battery compartment and the base material.

The foresaid side edge of the light transmission eyeball has a light shielding layer, to enforce the brightness of the anterior side of the eyeball.

The foresaid changeable facial expression configuration also includes a mouth shape changeable device, wherein the mouth shape changeable device includes a light transmission mouth shape body, at least two types of light transmission mouth shape pattern layers located in the light transmission mouth shape body that in accordance with the expressions of the eyeball, and a LED luminous body located with a certain distance in the rear area of the light transmission pattern layer that is able to respectively emit the light colors in accordance with the light colors of the light transmission mouth shape pattern layer.

The foresaid light transmission eyeball pattern layer is made up by the light transmission dye layer or the transparent materials with light transmission dyes.

The foresaid light transmission mouth shape pattern layer is made up by the light transmission dye layer or the transparent materials with light transmission dyes.

A changeable facial expression garment that is composed by the changeable facial expression configuration, including the garment and the changeable facial expression configuration, wherein the changeable facial expression configuration includes a facial expression layer and an eyeball changeable device; wherein the eyeball changeable device includes a light transmission eyeball body, and a light transmission eyeball pattern layer located in the light transmission eyeball body that is able to embody at least two different expression with different colors, and a luminous body located with a certain distance in the rear area of the pattern layer that is able to respectively emit the light colors in accordance with the light colors of eyeball pattern layer; The luminous body connects with the control circuit, and emits light alternately by the control of control circuit. The facial expression layer is printed in the garment body, and in the garment body that in accordance with the eyeball location of the facial expression layer has an eyeball hole in the light transmission eyeball body; The light transmission eyeball body is fixed in the eyeball hole; The circuit board is fixed in the garment and has electric connection with the light transmission body located in the rear area of the eyeball body.

The foresaid light transmission eyeball body is a solid eyeball structure; The inner surface of the front of the eyeball body has a light transmission eyeball pattern layer with two types of color that is able to embody at least two different expression, while at least two LED luminous body fixed in the circuit board of the rear area of the eyeball body that is able to emit the light color in accordance with the light transmission eyeball pattern layer, and connected with circuit control by wires.

The foresaid changeable facial expression configuration also includes mouth shape changeable device, wherein the mouth shape changeable device includes a light transmission mouth shape body, at least two types of light transmission mouth shape pattern layers located in the light transmission mouth shape body that in accordance with the expressions of the eyeball, and a LED luminous body located with a certain distance in the rear area of light transmission pattern layer that is able to respectively emit the light colors in accordance with the light colors of the light transmission mouth shape pattern layer.

By adopting the structure stated above, The changeable facial expression configuration in the invention exhibits pattern layers alternately by the light transmission eyeball pattern layer with two or more different colors that located in the light transmission eyeball body and the LED luminous body located with a certain distance in the rear area of light transmission pattern layer, and by omitting light with different colors from the LED luminous body, to achieve a perfect effect of eye movement or wink. The utility mode has merits with simple structure and less raw material consumption, and is able to apply in all the ornaments that need to decorate with changeable facial expression such as clothes, handbags, light-fixtures, fruit plates, even gravestones.

MODE OF CARRYING OUT THE INVENTION

Figure 1:
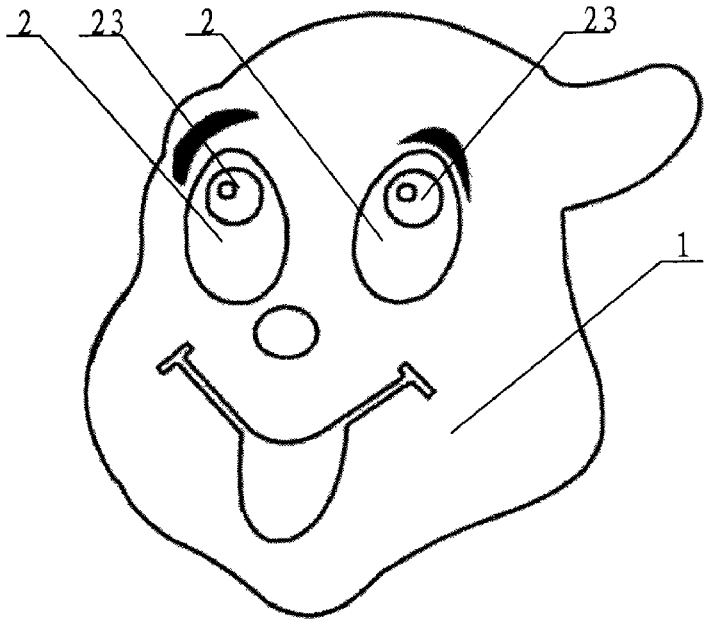
FIG. 1 is a structure figure of the invention.
Figure 2:
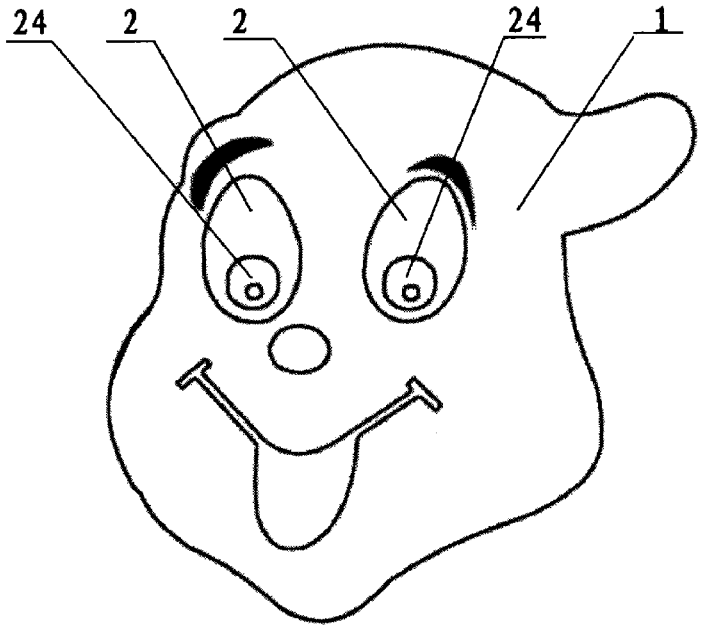
FIG. 2 is a structure figure of another posture of the invention.

Further explanation to the invention will be stated below combining with the attached figures and the mode of carrying out the invention:

As shown from FIG. 1 to FIG. 2, a changeable facial expression configuration, characterized in that it includes a facial expression layer 1 and an eyeball changeable device 2; wherein the eyeball changeable device 2 includes a light transmission eyeball body with solid eyeball structure and made up by transparent materials. The inner surface of the front of the eyeball body has the light transmission eyeball pattern layers 23, 24 with different types of color that are able to embody at least two different expressions. The light transmission eyeball pattern layers 23, 24 are made up by the light transmission dye layer or the transparent materials with light transmission dyes. At least two LED luminous bodies 41, 43 fixed in the circuit board of the rear area of the eyeball body that is able to emit the light color in accordance with the light transmission eyeball pattern layers 23, 24, and connected with circuit control by wires. The side edge 22 of the light transmission eyeball has a light shielding layer, to enforce the brightness of the anterior side of the eyeball, while the circumference edge in the rear area of light transmission eyeball has an annular fixing part 21 that is easy to fix the light transmission eyeball body.

The circuit control includes a battery compartment 3, a circuit board and control switch 4, wherein the circuit board located within the battery compartment 3; The right and left set of the battery compartment has right and left lugs 32 that fastened by the belt-style magic tape or joined by the belt-style strap, wherein the upside has a fixed loop 31 that could be stitched on the flexible base material, while the underside has a bottom lug 33 fixed on the base material; Or a fixture is located in the surface between the battery compartment and the base material.

Figure 3:
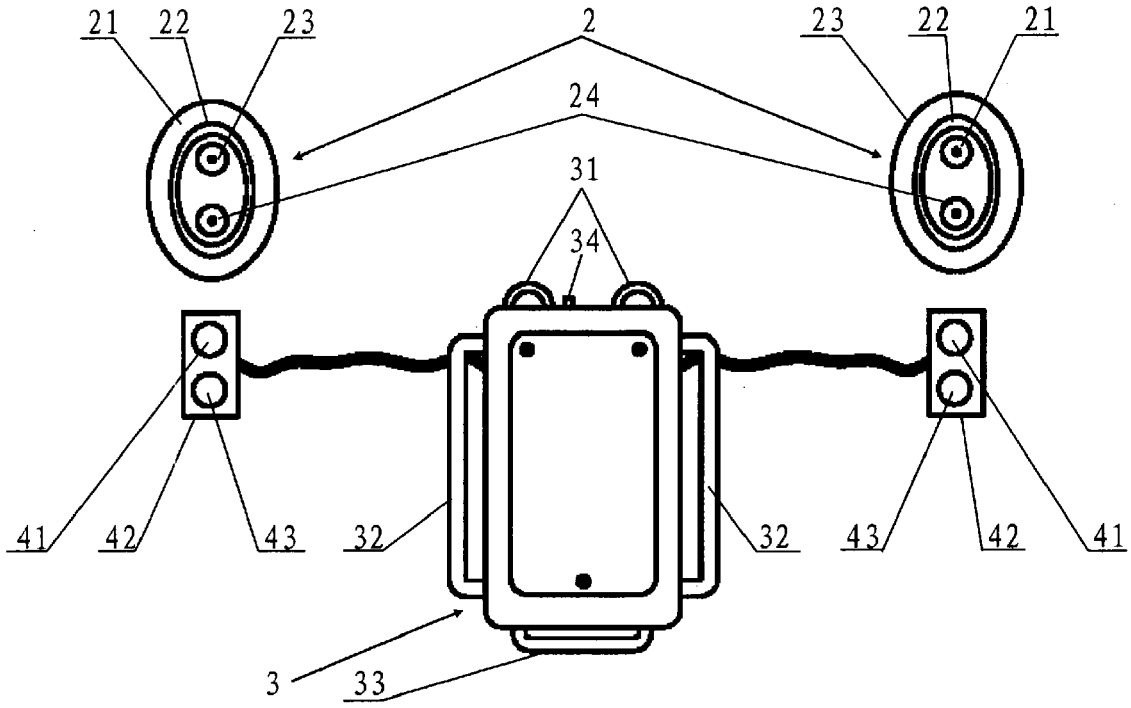
FIG. 3 is a structure figure of the eyeball changeable device.

As shown in FIG. 3, it is another facial expression configuration; it adds the mouth shape changeable device by compare with the first configuration. The mouth shape changeable device includes a light transmission mouth shape body, at least two types of light transmission mouth shape pattern layer 61 located in the light transmission mouth shape body that in accordance with the expressions of the eyeball, and the LED luminous bodies 51, 53 located with a certain distance in the rear area of light transmission pattern layer 61 that is able to respectively emit the light colors in accordance with the light colors of light transmission mouth shape pattern layer 61. The LED light transmission body is fastened in circuit board 52.

Figure 4:
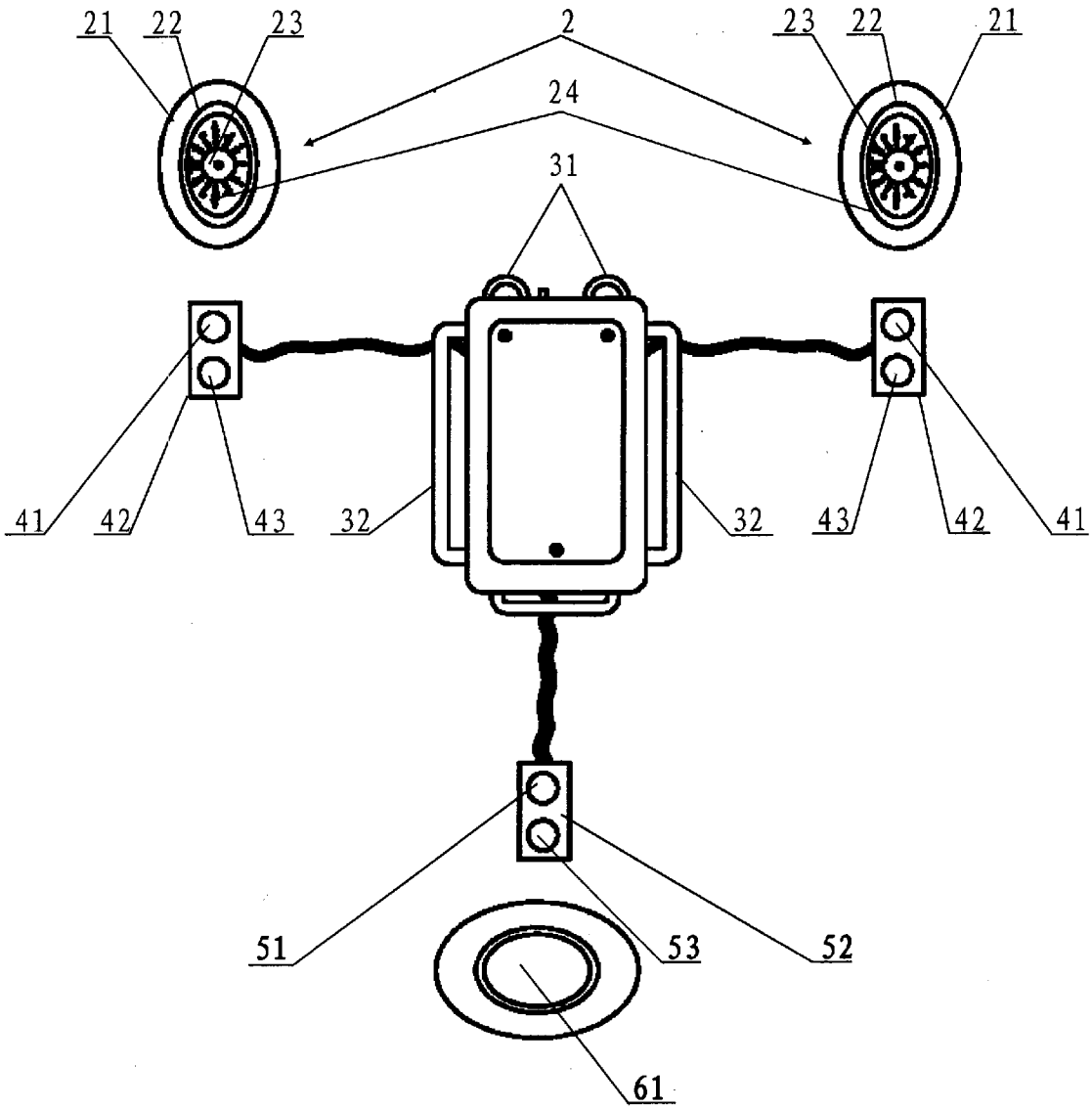
FIG. 4 is a structure figure of another eyeball changeable device.
Figure 5:
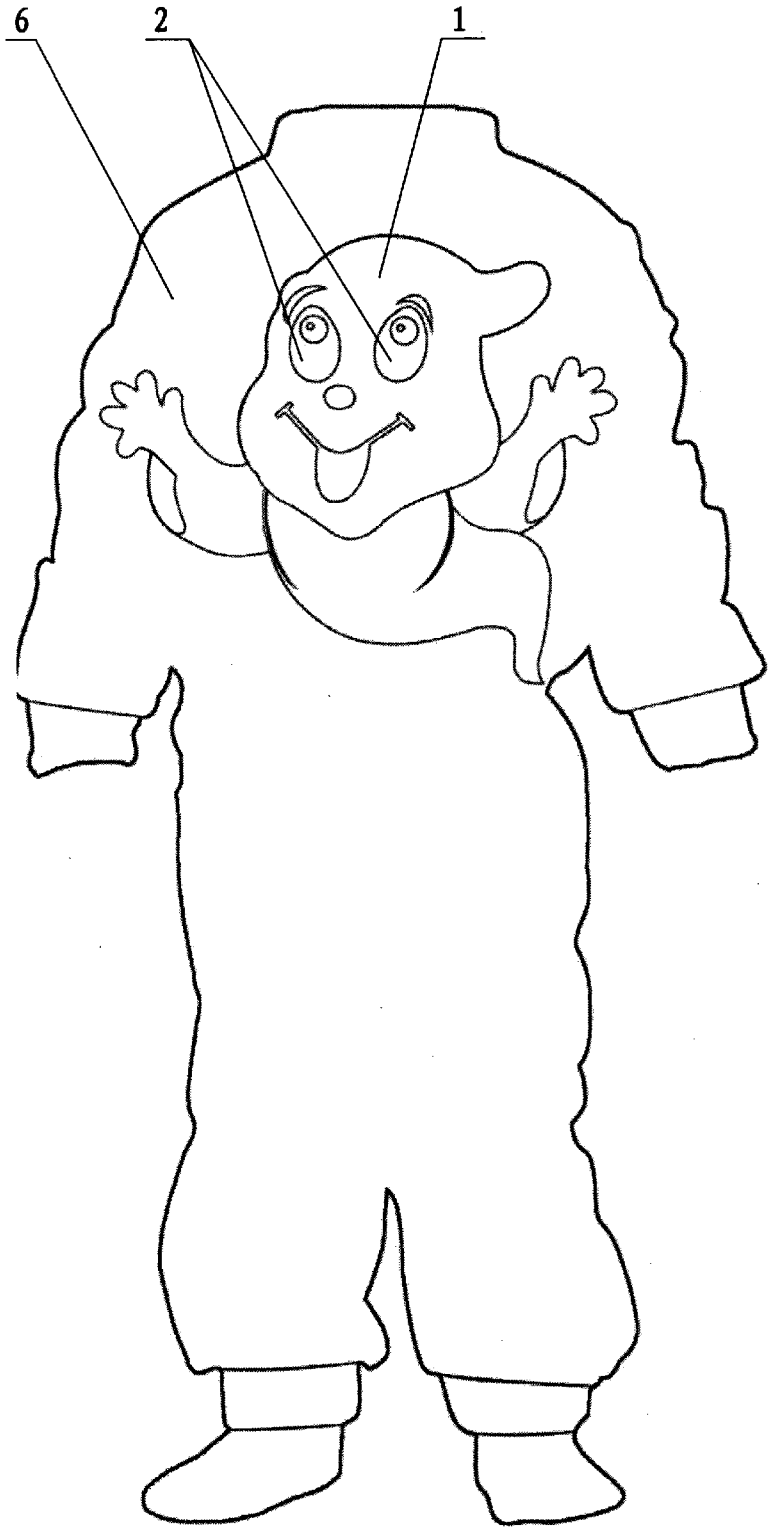
FIG. 5 is a structure figure of the changeable facial expression garment.

As shown in FIG. 4, it is the changeable facial expression garment that composed by the changeable facial expression configuration, including the garment 6 and the changeable facial expression configuration as shown in FIG. 1 to FIG. 3. The facial expression layer 1 is printed in the garment body 6, and in the garment body 6 that in accordance with the eyeball location of the facial expression layer has an eyeball hole in the light transmission eyeball body; The light transmission eyeball body is fixed in the eyeball hole; The circuit board is fixed in the garment and has electric connection with the light transmission body located in the rear area of the eyeball body.

The utility mode of the changeable facial expression configuration is able to apply to in all the ornaments that need to decorate with changeable facial expression such as houses, light-fixtures, fruit plates, gravestones and handbags and so on.

Explained in another manner, one embodiment of Applicant's invention is directed to a device configured to generate at least two facial expressions based on changing the positioning of a pupil and a iris for each of eyes incorporated in the facial expressions (as shown in FIGS. 1 and 2). The device may be incorporated with a garment.

The device preferably includes a facial expression layer 1 defining two eyes therein. Each of the cutouts in the facial expression layer 1 which represents one of the two eyes generally conforms to the outer edge of a cornea.

Referring to FIGS. 3 and 4, an eyeball changeable device 2 is preferably located generally adjacent the facial expression layer and is configured to provide additional details for the associated one of the two eyes of the facial expression layer when a person views the front of the device so that a portion of the device 2 is viewable through the cutout in the facial expression layer 1 that forms the eye.

Referring still to FIGS. 3 and 4, the eyeball changeable device 2 preferably includes a light permeable eyeball pattern layer 23 (also alternatively referred to as a light transmission eyeball pattern layer above). The light permeable pattern area may define first and second pupil and iris pairs 23, 24. The first and second pupil and iris pairs 23, 24 preferably have at least one different color from each other. As shown in FIGS. 1 and 2, the first and second pupil and iris pairs 23, 24 preferably have the same general shape and have a size of the pupil relative to the associated iris that is relatively the same.

A luminous body may be located adjacent the light permeable eyeball pattern area 23 on a side thereof opposite from the facial expression layer. The luminous body can include two single light sources 41, 43 (also alternatively referred to as LEDs above) each configured to solely illuminate, without assistance from an additional light source, a different one of the first and second pupil and iris pairs 23, 24.

A controller 42, 52 (also alternatively referred to as a circuit board above) may activate one of the two single light sources 23, 24 to change the apparent positioning of the pupil and iris within one of the two eyes in the facial expression layer 1. The facial expression is preferably changed by modifying the position of the illuminated one of the first and second pupil and iris pairs 23, 24 and by possibly changing the at least one color associated with the illuminated one of the first and second pupil and iris pairs 23, 24.

The light permeable eyeball pattern 23. 24 area may include a solid eyeball structure. An inner surface of the light permeable eyeball pattern area can have at least two different colors. The two single light sources 41, 43 preferably each comprising a light emitting diode (LED) fixed on the controller 42, 52 on a side of the light permeable eyeball pattern opposite from the facial expression layer 1.

Referring to FIG. 3, a battery compartment 3 is preferably electrically connected with the controller 42, 52 and may include at least two lugs 32 thereon adapted to be fastened to the garment via belt-style magic tape or a belt-style strap. The battery compartment may have a fixed loop 31, 33 thereon adapted to be secured via stitching to the garment.

The light permeable eyeball pattern layer may include an edge 22 generally corresponding to a perimeter of the cornea. The edge 22 forming a light shielding layer to enhance the brightness of the cornea portion of the associated eye.

Referring to FIG. 4, the facial expression layer 1 may further defines a mouth, The mouth may include a light permeable area. At least two mouth shape pattern layers 61 can be positioned in the light permeable area. A second luminous body may be positioned proximate the light permeable area and configured to illuminate one of the at least two mouth shape pattern layers based on the illumination of the eyes so that light coming from the mouth coordinates with color coming from the two eyes.

The light permeable eyeball pattern layer may include one of the group of a translucent dye layer and a transparent material with translucent dye thereon. The light permeable area forming the mouth may also be made up by the light transmission dye layer or the transparent materials with light transmission dyes. A garment may have the device with the facial expression layer positioned thereon.

The invention claimed is:

1. A device configured to generate at least two facial expressions based on changing the positioning of a pupil and a iris for each eye incorporated in the facial expressions, the device being configured for incorporation with a garment, comprising:

a facial expression layer defining two eyes therein, each of the two eyes representing a cornea;

an eyeball changeable device located adjacent the facial expression layer and configured to provide additional details for the associated one of the two eyes of the facial expression layer;

the eyeball changeable device comprising a light permeable eyeball pattern layer;

The light permeable pattern area defining first and second pupil and iris pairs, the first and second pupil and iris pairs having at least one different color from each other, wherein the first and second pupil and iris pairs of each of the two eyes having an identical shape and size;

a luminous body located adjacent the light permeable eyeball pattern area on a side thereof opposite from the facial expression layer, the luminous body including two single light sources each configured to solely illuminate, without assistance from an additional light source, a different one of the first and second pupil and iris pairs; and a controller for activating one of the two single light sources to change the positioning of the pupil and iris within one of the two eyes in the facial expression layer, wherein the facial expression is changed by modifying the position of the illuminated one of the first and second pupil and iris pairs and changing the at least one color associated with the illuminated one of the first and second pupil and iris pairs.

2. The device of claim 1, wherein the light permeable eyeball pattern area comprises a solid eyeball structure, an inner surface of the light permeable eyeball pattern area has at least two different colors, the two single light sources each comprising a light emitting diode (LED) fixed on the controller on a side of the light permeable eyeball pattern opposite from the facial expression layer.

3. The device of claim 2, wherein the light permeable eyeball pattern layer further comprises an edge corresponding to a perimeter of the cornea, the edge forming a light shielding layer to enhance the brightness of the cornea portion of the associated eye.

4. The device of claim 3, further comprising the garment with the facial expression layer thereon.

5. The device of claim 1, further comprising a battery compartment electrically connected with the controller, the battery compartment including at least two lugs thereon adapted to be fastened to the garment via belt-style magic tape or a belt-style strap, the battery compartment having a fixed loop thereon adapted to be secured via stitching to the garment.

6. The device of claim 1, wherein the facial expression layer further defines a mouth, the mouth comprising a light permeable area, at least two mouth shape pattern layers are positioned in the light permeable area, a second luminous body being positioned proximate the light permeable area and configured to illuminate one of the at least two mouth shape pattern layers based on the illumination of the eyes so that light coming from the mouth coordinates with color coming from the two eyes.

7. The device of claim 6, wherein the light permeable area is made up by the light transmission dye layer or the transparent materials with light transmission dyes.

8. The device of claim 6, further comprising the garment with the facial expression layer thereon.

9. The device of claim 1, wherein the light permeable eyeball pattern layer comprises one of the group of a translucent dye layer and a transparent material with translucent dye thereon.

10. The device of claim 1, further comprising the garment with the facial expression layer thereon.

* * * * *